US007018302B2

(12) United States Patent
Jacoby

(10) Patent No.: US 7,018,302 B2
(45) Date of Patent: Mar. 28, 2006

(54) ADJUSTABLE SHAFT-EXTENSION APPARATUS FOR GOLF CLUB PUTTERS

(76) Inventor: Mark Robert Jacoby, 3100 Altura Ct., No. 202, Corona, CA (US) 92882

( * ) Notice: Subject to any disclaimer, the term of this patent is extended or adjusted under 35 U.S.C. 154(b) by 0 days.

(21) Appl. No.: 10/140,277

(22) Filed: May 6, 2002

(65) Prior Publication Data

US 2003/0207723 A1 Nov. 6, 2003

(51) Int. Cl.
*A63B 53/16* (2006.01)

(52) U.S. Cl. ..... 473/294; 473/296

(58) Field of Classification Search ..... 473/298, 473/296, 294, 288, 299, 307, 239; 280/823; D21/734, 756, 757; 403/293, 294, 296, 297
See application file for complete search history.

(56) References Cited

U.S. PATENT DOCUMENTS 5,188,361 A * 2/1993 Coombe ..... 473/294
5,390,921 A * 2/1995 De Ruyter ..... 473/299
6,213,890 B1 * 4/2001 Prince ..... 473/292

OTHER PUBLICATIONS

US 2002/0091012 patent application Publication date Jul. 11, 2002, Evans, figures 1, 2, 3A, p. 2.*

* cited by examiner

*Primary Examiner*—Stephen Blau
(74) *Attorney, Agent, or Firm*—Leonard Tachner

(57) ABSTRACT

An apparatus which may be used to convert conventional length putters to long putters while also providing an adjustment feature over a large range to accommodate virtually all golfers who wish to use long putters which have the precise length suited to their individual needs. The preferred embodiment comprises a first extension shaft which is a hollow tube inserted into the upper end of the conventional putter shaft after an end portion of the grip has been removed to reveal the upper end. The first extension shaft terminates in a threaded portion. A threaded nut is then secured to the threaded portion. A second extension shaft, slightly smaller in diameter than the first extension shaft, is then inserted into the first extension shaft to achieve the desired putter length including an extension grip affixed to the upper end of the second extension shaft. Another threaded nut is then placed on the remaining portion of the threaded portion and in surrounded engagement with the second extension shaft to set the overall length by tightening set screws.

4 Claims, 4 Drawing Sheets

ADJUSTABLE SHAFT-EXTENSION APPARATUS FOR GOLF CLUB PUTTERS

BACKGROUND OF THE INVENTION

1. Field of the Invention

The present invention relates generally to the field of golf clubs and more specifically to an apparatus for selectively extending the length of a golf club putter shaft to adjustably extend the putter for various putting styles.

2. Background Art

Traditional golf club putters have lengths of approximately three feet. They are positioned so that the putter head is just behind the ball at address. In this position, the upper or grip end of the putter is held with two hands that are closely spaced or overlapping at or below the golfer's waist. The shaft may be slightly tilted upwardly toward the golfer so that the golfer's hands are closer to the body than is the ball.

In the past several years, some golfers have begun using a non-conventional golf club putter that is much longer than the traditional putter. With an extra foot or more of overall length, this longer putter is typically positioned so that its upper or grip end is pressed against the chest with one hand while the other hand supports the putter weight at a spaced, lower location along the putter shaft. The long putter is usually held vertically (not tilted) at address while the golfer views the ball along the entire length of the shaft. Other techniques for using the long putter are common. For example, some golfers may user their chin upon which to rest the grip end while employing both hands to swing the putter. The theory of such longer putters is that the golfer develops a more pendulum-like swing and sees a more accurate line or path to the hole, thereby producing more accurate and more consistent putting strokes.

The length of such long putters depends on the height of the golfer and the location of the grip end on the body of the golfer. Some may prefer to locate the grip end at the lower end of the rib cage. Others may prefer a position between the pectoral chest muscles. Women golfers may prefer a location along their breast cleavage. As previously indicated, some golfers may prefer to rest the grip end under their chin. Wherever a golfer may choose to position the grip end of a long putter, it is important that the putter head then be at or just above the surface of the green for proper striking of the ball. The length of traditional golf club putters is far less critical because the grip end need not be positioned in such a critical manner and the tilting angle may be adjusted to compensate for length.

The criticality of long putter length for each golfer is a disadvantageous aspect of long putters. This aspect requires that each golfer who wishes to use a long putter have the putter length specially tailored to his or her specific requirements. Otherwise, manufacturers of such long putters must provide a large selection of different putter lengths to provide each prospective purchaser with an opportunity to select the long putter most suitable for his or her height and grasping technique.

It would therefore be highly advantageous if there were a way to adjust the length of putters to any desired extent. Moreover, it would be additionally advantageous if it were possible to vary the putter length over a large range to accommodate virtually all golfers. It would be even more advantageous if it were possible to modify conventional length putters to extend their lengths to provide a long putter having the aforementioned adjustable features.

SUMMARY OF THE INVENTION

The present invention comprises an apparatus which may be used to convert conventional length putters to long putters while also providing an adjustment feature over a large range to accommodate virtually all golfers who wish to use long putters which have the precise length suited to their individual needs.

The preferred embodiment of the invention illustrated herein, comprises a first extension shaft which is a hollow tube inserted into the upper end of the conventional putter shaft after an end portion of the grip has been removed to reveal the upper end. The first extension shaft terminates in a threaded portion. A threaded nut is then secured to the threaded portion. The nut has an annular recess to receive the end of the putter shaft and a plurality of set screws to affix the nut both to the putter shaft and to the first extension shaft. A second extension shaft, slightly smaller in diameter than the first extension shaft, is then inserted into the first extension shaft to achieve the desired putter length including an extension grip affixed to the upper end of the second extension shaft. Another threaded nut is then placed on the remaining portion of the threaded portion and in surrounded engagement with the second extension shaft to set the overall length by tightening set screws. The two threaded nuts are configured to mate vertically along the extension shafts to provide an aesthetically pleasing assembly.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which:

FIG. 3, comprising

FIG. 4, comprising FIG. 5, comprising

DETAILED DESCRIPTION OF A PREFERRED EMBODIMENT

Figure 1:
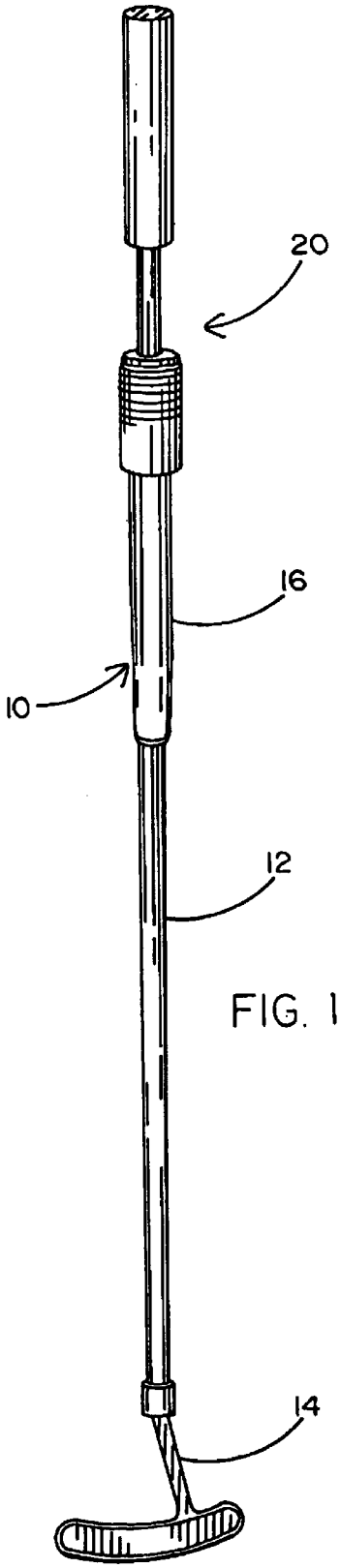
FIG. 1 is a view of a fully assembled long putter in accordance with a preferred embodiment of the invention.
Figure 3A:
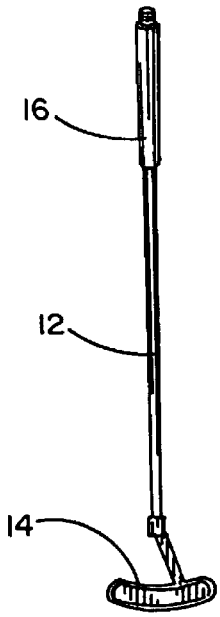
FIGS. 3*a* and 3*b*, illustrates a first step in conversion of a conventional putter to a long putter.
Figure 3B:
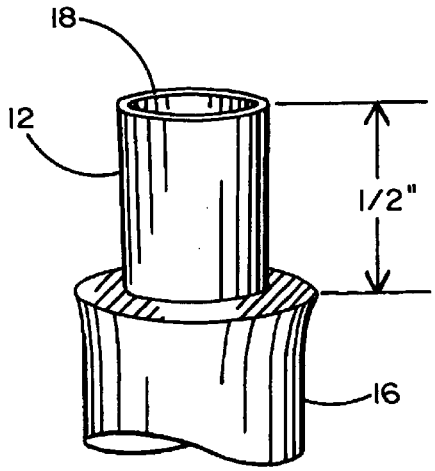

Referring to the accompanying drawings, it will be seen in FIG. 1 that in a conversion embodiment of the present invention, an adjustable length long putter 10 employs a conventional putter shaft 12 attached at one end to a conventional putter head 14. The other end of shaft 12 terminates in a conventional putter grip 16 which has been partially cut away to reveal shaft 12 at its exposed end 18 as shown best in FIGS. 3*a* and 3*b*. A long putter extension assembly 20 is attached to the conventional shaft 12 in a manner to be described in detail hereinafter in conjunction with FIGS. 2, 4*a* 4*b*, 5*a*, and 5*b*.

Figure 2:
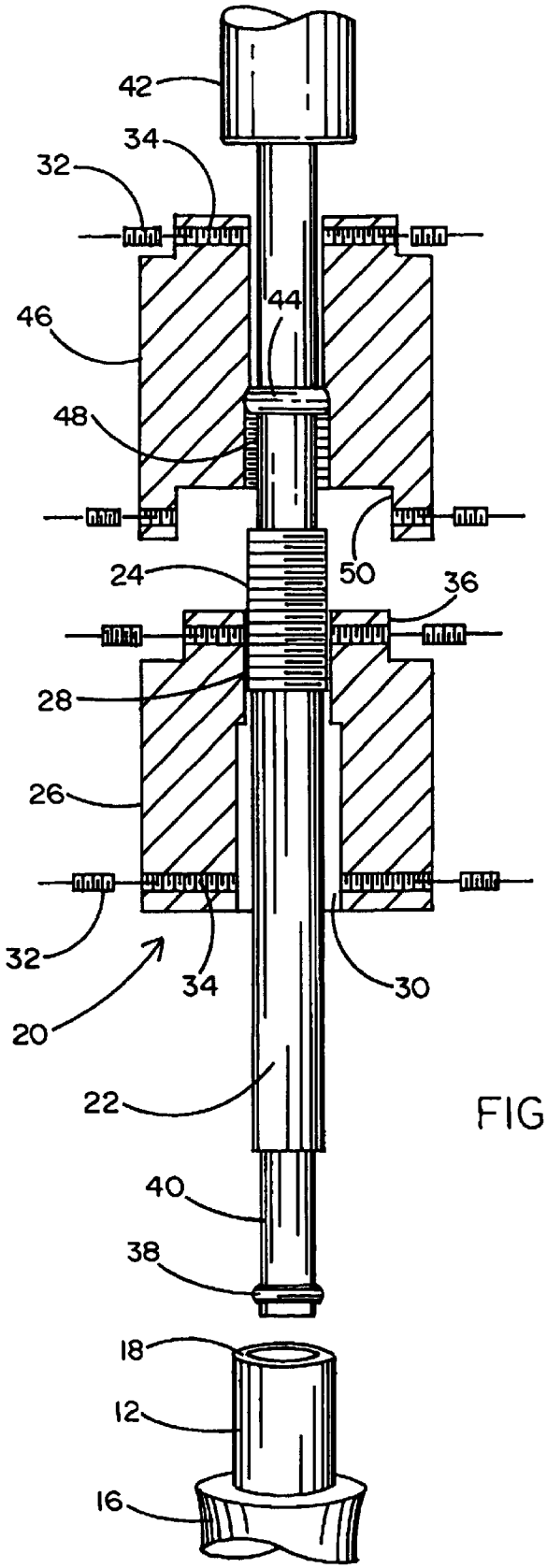
FIG. 2 is an exploded view of the extension assembly of the invention.
Figure 4A:
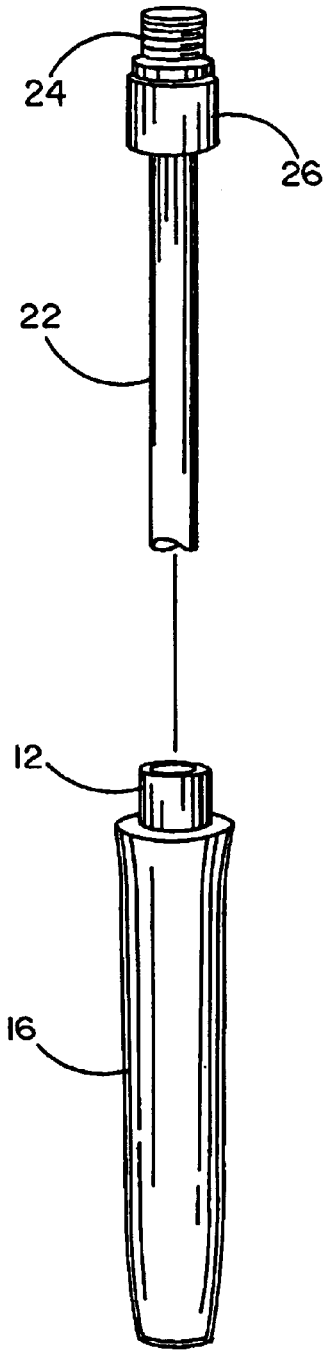
FIGS. 4*a* and 4*b*, illustrates a second step in the aforementioned conversion.
Figure 4B:
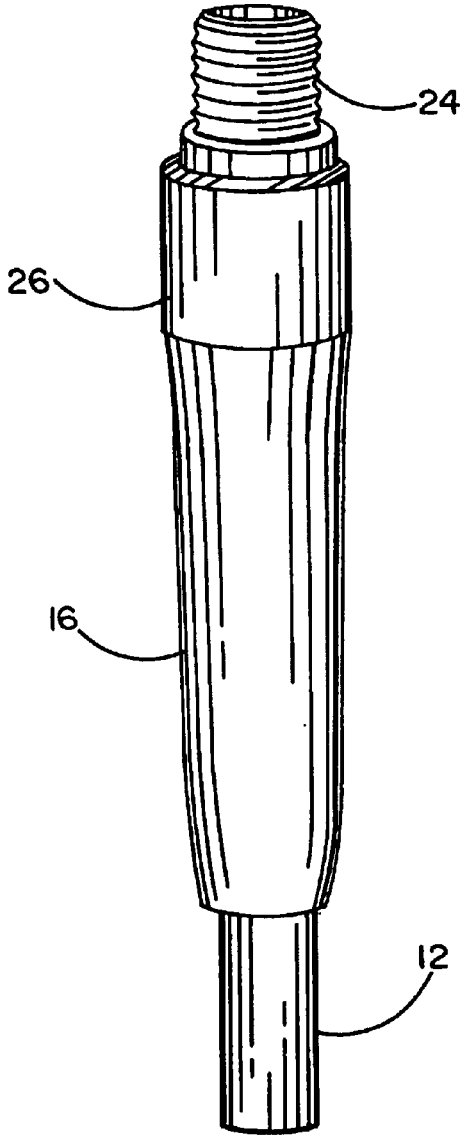
Figure 5A:
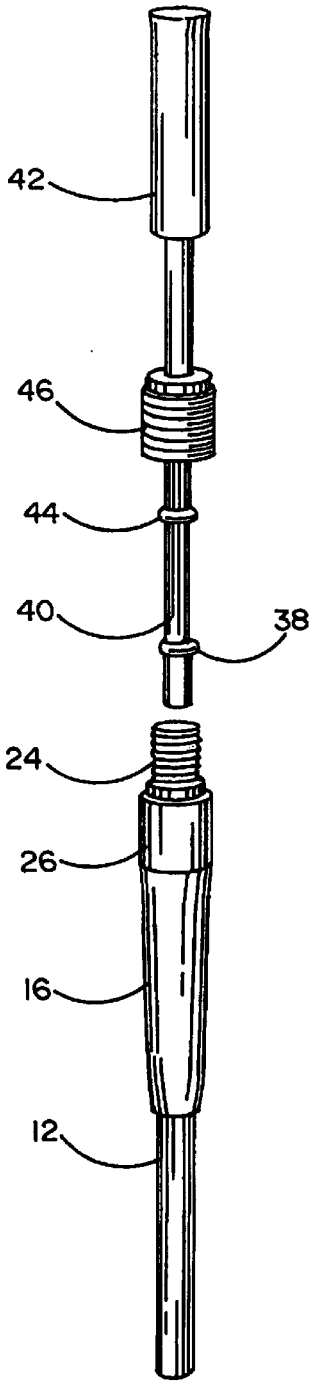
FIGS. 5*a* and 5*b*, illustrates a third step in the aforementioned conversion.
Figure 5B:
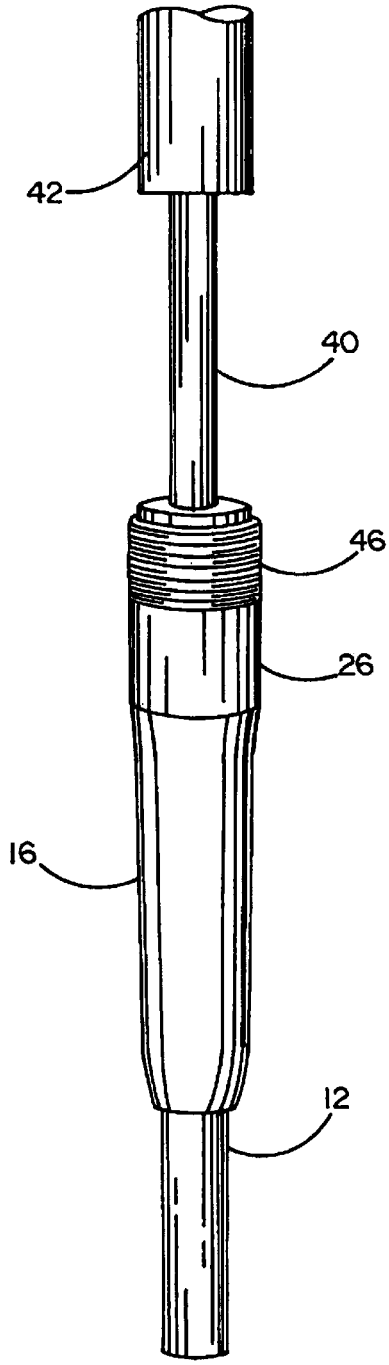

It is seen in FIG. 2 that assembly 20 comprises a first or outer extension shaft 22 having a threaded end 24. Shaft 22 is a hollow tube which is smaller in diameter than shaft 12 at end 18. A coupling nut 26 has a threaded aperture 28 which threadably mates with threaded end 24. Below the threads, aperture 28 expands into an annular recess 30 which is configured to receive end 18 of shaft 12. A plurality of set screws 32 are received in threaded holes 34 to provide locking of shaft 22 inside shaft 12 (see FIGS. 4*a* and 4*b*). The upper end of nut 26 provides a reduction step 36.

Assembly 20 also comprises a second or inner extension shaft 40 which terminates at its upper end in an extension grip 42. Shaft 40 may be a solid tube and has a smaller diameter than shaft 22. The lower end of shaft 40 has an "O" ring 38 for stabilizing the lower end of shaft 40 within shaft 12 after assembly 20 is fully installed. The shaft 40 also has a slidable compression ring 44 which helps to secure the shaft 40 to a coupling nut 46. Nut 46 has a partially threaded aperture 48 for threadably engaging threaded end 24 of shaft 22. The remaining portion of aperture 28 may be left unthreaded. Nut 46 has a recess 50 at its lower end for coupling with reduction step 36 of nut 26. A plurality of set screws 32 and threaded holes 34 serve the same function for nut 46.

As seen in FIGS. 4*a*, 4*b*, 5*a* and 5*b*, after the shaft 12 is exposed at end 18, outer extension shaft 22 is lowered into shaft 12 until nut 26 fully engages end 18. The set screws 32 are then tightened into thread holes 34 of nut 26 so that the nut is secured to shaft 12 at end 18 with threaded end 24 of shaft 22 having threads exposed above nut 26. The set screws 32 of nut 26 need not be loosened thereafter unless it is desired to entirely remove assembly 20 from putter 10.

Shaft 40 is then inserted into shaft 22 at the threaded end 24 until nut 46 engages nut 26 at step 36 and recess 50. The position of nut 46 on shaft 22 determines the overall length of putter 10. That position may be readily altered by simply sliding the shaft 40 through nut 46 and compression ring 44 in either direction before securing set screws 32 into holes 34 of nut 46. Once the desired length is achieved, the set screws 32 are tightened to engage shaft 40 and to affix the coupling nut 46 to the coupling nut 26. Altering the length requires merely loosening the set screws, moving shaft 40 up or down and then re-tightening the set screws.

Having thus disclosed a preferred embodiment of the invention, it will now be apparent to those having skill in the relevant arts, that numerous alternative embodiments are contemplated. By way of example, while the disclosed embodiment is configured to permit conversion of a conventional putter to an adjustable length long putter, other embodiments employing the principal features hereof may be more suited to providing an originally-manufactured adjustable long putter. Such originally-manufactured long putters may for example have an integrated assembly with a permanently affixed threaded end which would obviate outer extension shaft 22. Moreover, whether in a conversion embodiment or in an originally-manufactured embodiment, other forms of coupling and affixing the components thereof are also readily perceived by those who now have the benefit of the above disclosure. Accordingly, the invention herein described is not to be limited except by the scope of the appended claims and their equivalents.

I claim:

1. A golf club putter having a putter head affixed to an end of an elongated shaft, the shaft having a grip section at another end of the shaft, the putter having an apparatus for adjustably extending the length of the putter at the grip section end of the shaft; the apparatus comprising:

at least one extension shaft slidably positioned within said elongated shaft; and at least one coupling device selectively affixed to said elongated shaft and to said extension shaft for fixing the extension of said length;

wherein said at least one extension shaft comprises a first extension shaft for insertion into said grip section end of said elongated shaft and having a threaded end protruding in abutting fixed relation to said grip section end; and a second extension shaft selectively and slidably engaged with said first extension shaft;

said coupling device having a threaded aperture for engaging said threaded end of said first extension shaft and a compression ring for engaging said second extension shaft.

2. The putter recited in claim 1, said coupling device having at least one fastening device for locking said coupling device to said at least one extension shaft to prevent inadvertent repositioning of said extension shaft relative to said elongated shaft.

3. An apparatus for adjustably extending the length of a golf club putter, the putter having a shaft having a head end and a grip end, the apparatus comprising:

an extension shaft adjustably connected to said putter shaft to add length to said putter by a selected extent depending upon the degree to which said extension shaft protrudes beyond the grip end of said putter shaft; and a fastening device for fixing said extension shaft to said putter shaft after selected adjustment of said extension shaft;

wherein said extension shaft comprises:

a first extension shaft for insertion into said grip end of said elongated shaft and having a threaded end protruding in abutting fixed relation to said grip end; and a second extension shaft selectively and slidably engaged with said first extension shaft;

said fastening device having a threaded aperture for engaging said threaded end of said first extension shaft and a compression ring for engaging said second extension shaft.

4. The apparatus recited in claim 3, said fastening device having at least one device for locking said fastening device to said at least one extension shaft to prevent inadvertent repositioning of said extension shaft relative to said elongated shaft.

* * * * *